US005379807A

United States Patent [19]

Kelley et al.

[11] Patent Number: 5,379,807

[45] Date of Patent: Jan. 10, 1995

[54] SHUTTLE WEFT YARN CONTROL

[76] Inventors: Jerry Kelley; Mike Kelley, both of 1632 Gentry Memorial Hwy., Easely, S.C. 29641

[21] Appl. No.: 155,599

[22] Filed: Nov. 22, 1993

[51] Int. Cl.[6] ..... D03D 45/50

[52] U.S. Cl. ..... 139/203; 139/212

[58] Field of Search ..... 242/19; 139/212, 213, 139/214, 215, 216, 217, 201, 203, 205

[56] References Cited

U.S. PATENT DOCUMENTS

| | | | |
|---|---|---|---|
| 644,895 | 3/1900 | Carpentier | 139/216 |
| 980,093 | 12/1910 | Garisio | 139/203 |
| 1,438,559 | 12/1922 | Six . | |
| 1,519,942 | 12/1924 | Thigpen . | |
| 1,711,227 | 4/1929 | Davol . | |
| 1,840,504 | 1/1932 | Graf | 139/214 |
| 1,924,179 | 8/1933 | Cederlund . | |
| 2,008,458 | 7/1935 | Lappas . | |
| 2,306,287 | 12/1942 | Turner . | |
| 2,383,239 | 8/1945 | Coldwell . | |

*Primary Examiner*—Andrew M. Falik

*Attorney, Agent, or Firm*—Henry S. Jaudon; Cort Flint

[57] ABSTRACT

A weft thread tension control device for use in bobbin carrying shuttles. These shuttles include a bobbin compartment which supports a weft thread carrying bobbin, a weft thread tensioning apparatus which tensions the weft thread during its passage out of the shuttle and shuttle eyes which guide the weft thread from said shuttle. The tension control device comprises a tension actuated apparatus which is operative to sever the weft thread along its path of movement from the bobbin through the shuttle eyes upon the development of excessive tension therein.

9 Claims, 4 Drawing Sheets

SHUTTLE WEFT YARN CONTROL

BACKGROUND OF THE INVENTION

When weaving with wide looms of the type used to weave paper forming fabrics, the shuttles are extremely large weighing up to five pounds and being slightly less than three feet long. These shuttles are picked through warp sheds which are up to thirty yards in width. In order to propel the shuttle over this distance, it requires a tremendous force from the picking mechanism. Should something interfere with the flight of the shuttle and cause it to leave its path of travel along the race of the sley, the shuttle will tear through the warp yarns forming the shed, breaking literally hundreds of these yarns, and fly uncontrolled through the weave room. This phenomena is called a tear out or a smash out. Such an occurrence is extremely dangerous. It is also extremely expensive as the warp yarns cannot be repaired because the repair would cause marks on the fabric surface which in turn would cause marks on the paper product formed on the paper forming fabric. A smash out results in major down time and extensive waste of materials, both of which are expensive.

A major cause for shuttle smash outs has been determined to be the development of excessive tension in the weft yarn during its passage out of the shuttle during flight. This is usually caused by the yarn becoming entangled and snarled so that it will not pull freely from the bobbin. Because of the strength of the thread used for weaving forming fabrics, the snarled thread jerks the shuttle from its path of flight into a path through the warp threads.

The prior art does not reveal any special attempts having been made to prevent smash outs. U.S. Pat. Nos. 1,924,179 to Cederlund and 2,306,287 to Turner show weft thread cutters associated with the shuttle; however, these patents are concerned with automatic replenishing. U.S. Pat. No. 2,383,239, to Coldwell shows weft tensioning structure also associated with automatic replenishing.

Accordingly, it is an object of this invention to prevent smash outs caused by the failure of the weft thread to run freely out of the shuttle.

Another object of the invention is to prevent excessive tension from developing in the weft thread during picking Another object of the invention is to provide an excessive tension preventing apparatus which is carried by the shuttle.

Another object of the invention is to provide a weft severing device carried by the shuttle which is activated in response to weft tension during picking.

SUMMARY OF THE INVENTION

The invention is directed to a weft thread tension control device for use with a wide loom shuttle such as those used in the weaving of paper forming fabrics. The tension control device includes a housing having a pair of spaced, stationary eyes which are adapted to pass the weft thread during passage of the shuttle across the loom. A cutting member is arranged intermediate the eyes but within the housing. Additional vertically movable thread guides are arranged intermediate the eyes and adjacent to the cutting member. The thread guide means are resiliently maintained in a normal position in which the weft thread is guided from a first eye over the cutting member and out the second eye.

The thread guides are operative to be moved or pivoted by the weft thread when under excessive tension into a position in which the weft thread comes into engagement with the cutting member and is cut to relieve the excessive tension during passage of the shuttle.

The thread guides may comprise an arm pivotally mounted within the housing and springs arranged also within the housing which urge the arm into its normal position. The guides may comprise a pair of pivotally mounted arms within the housing which are arranged adjacent each side of the cutting member. Individual springs are associated with each arm to urge it into the normal position. These individual springs are each adjustable. The guide arms may each include an eye through which the weft thread passes. These eyes are normally arranged to be along a common plane. The stationary eyes formed in the housing and the movable eyes formed in the arms are arranged along a common plane. The eyes may be provided with a carbide bushing.

The cutting member comprises a cutting blade which is removably mounted within the housing. A preferred cutting member is a commercial single edged razor blade.

The invention is also directed to a method for preventing shuttle smash outs during weaving which comprises a method of preventing excessive weft tension during picking. The method includes providing a tension controlled weft thread cutting device within the shuttle, and automatically cutting the weft thread upon the indication of excessive tension in the weft thread during the flight shuttle.

DESCRIPTION OF THE DRAWINGS

The construction designed to carry out the invention, together with other features thereof will be described hereinafter.

The invention will be more readily understood from a reading of the following specification and by reference to the accompanying drawings thereof, wherein an example of the invention is shown and wherein.

DESCRIPTION OF THE PREFERRED EMBODIMENT

Figure 3:
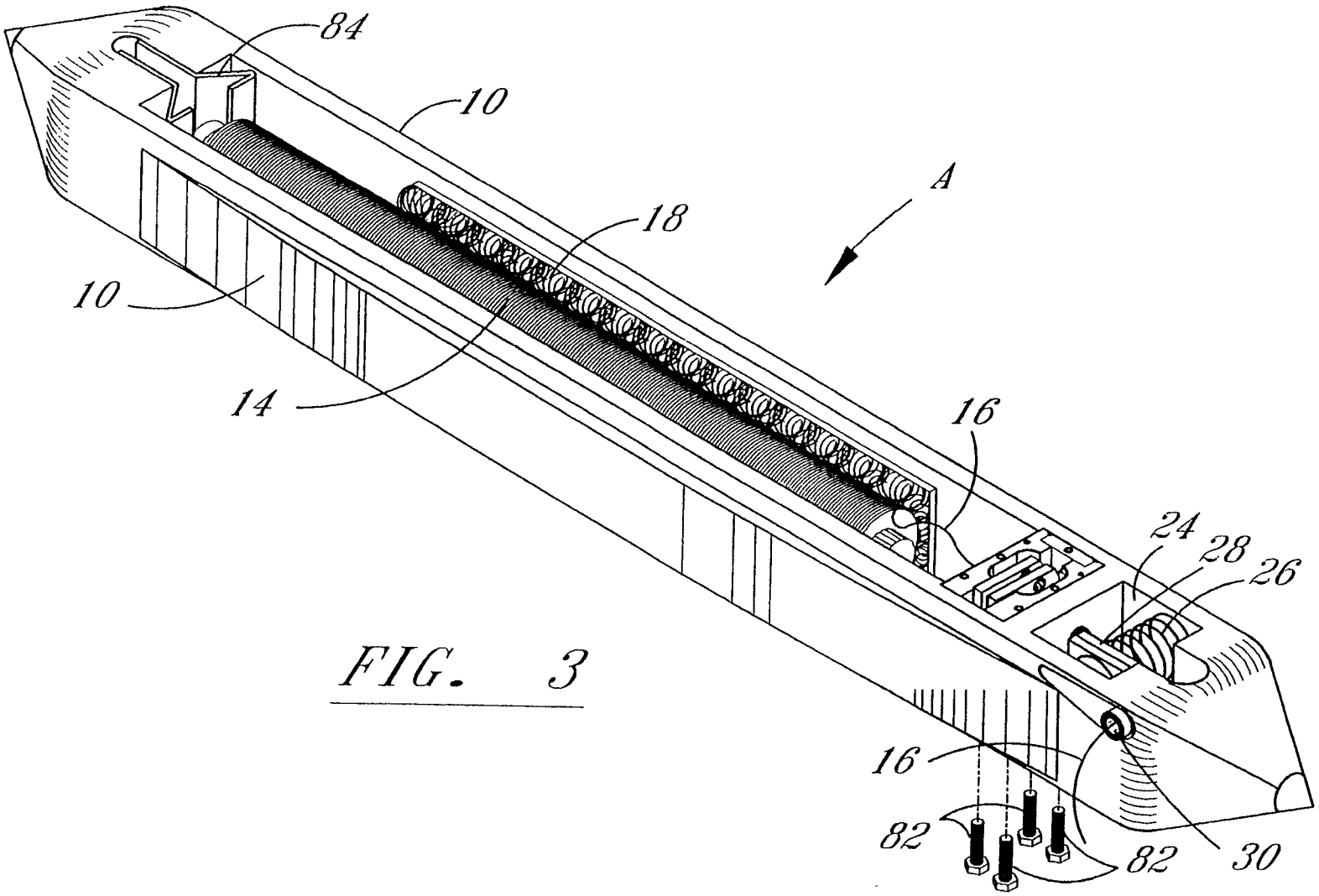
FIG. 3 is a perspective view of a shuttle mounting the weft tension device of the invention.
Figure 4:
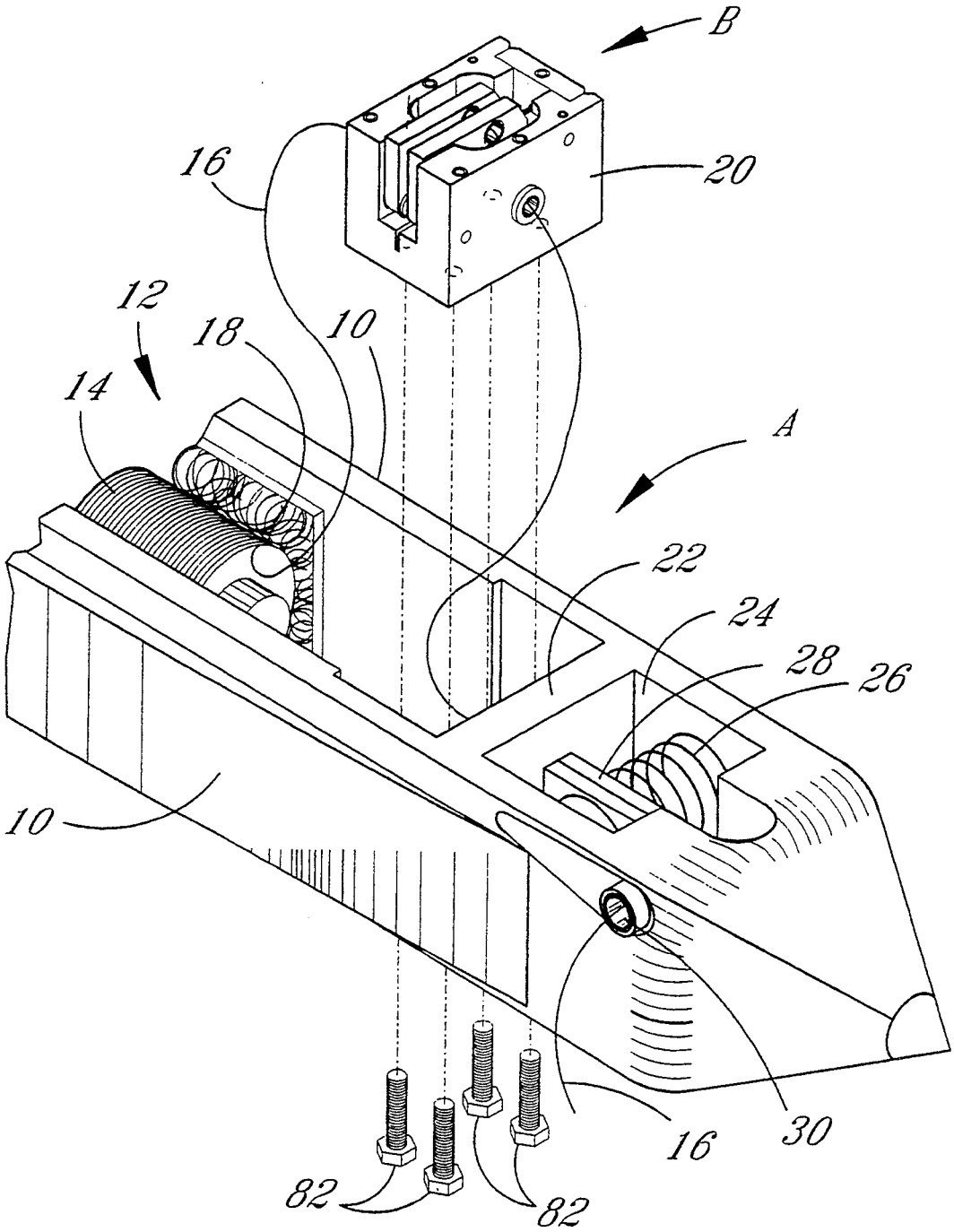
FIG. 4 is a break away perspective view of the thread delivery end of a shuttle showing the tension control apparatus relative to the path of the weft thread out of the shuttle.

Referring now to the drawings, FIGS. 3 and 4 show a typical bobbin carrying shuttle A having a pair of side walls 10 forming a bobbin carrying compartment 12. Bobbin 14 shown carrying weft yarn 16, which is wound thereon, is held within the bobbin compartment 12 by bobbing clamp 84. As is usual, the inner surfaces of walls 10 are lined with fleece 18 or with some other suitable weft tensioning material.

Just forward of the bobbin carrying compartment, weft tension control device B is mounted. Tension control device B, which will be described hereinafter in more detail, is shown with weft yarn 16 passing through its housing 20. Tension control device B is secured in the forward end of bobbin compartment 12 by means of screws 82 which pass through the floor of the compartment to secure with housing 20. Forward of control device B there is formed a transverse wall 22 which connects with the inner surfaces of side walls 10. An eye, which is not shown, is formed in wall 22 to allow weft 16 to pass from housing 20 through wall 22 and into tension chamber 24. Tension chamber 24 is of usual construction and includes a pair of blocks 28 which are urged into abutting relationship by opposed springs 26 (only one of which is shown). Shuttle eye 30 is formed in one side wall 10 adjacent to the forward end of tension chamber 24.

Weft yarns 16 passes from bobbin 16 through housing 20, through the eye in wall 22, between blocks 28 and out eye 30 during its path of travel from shuttle A during picking. Every feature so far discussed is old, with the exception of housing 20 of tension control device B.

Figure 1:
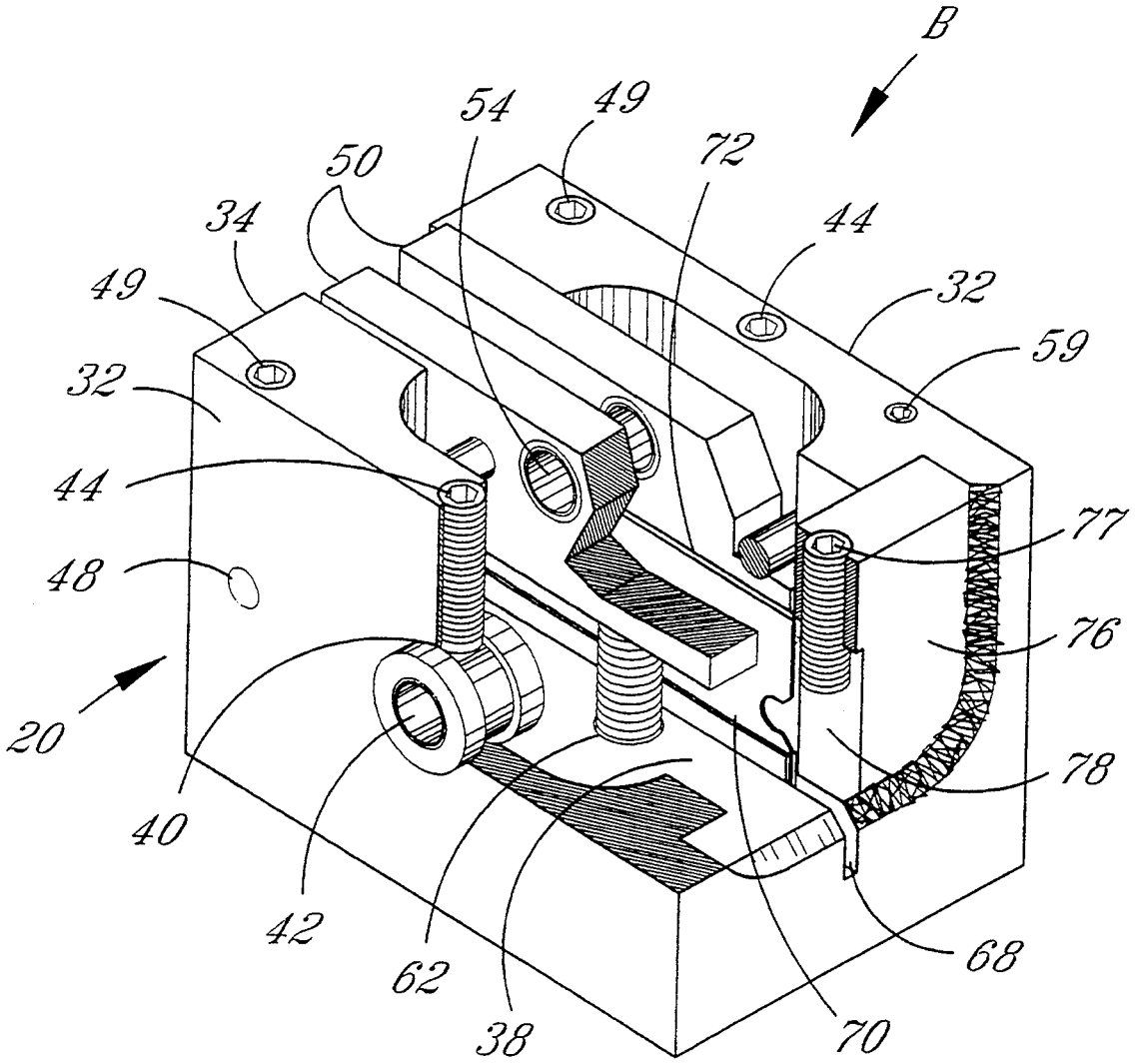
FIG. 1 is a cut away perspective view of the shuttle mounted tension control device of the invention.
Figure 2:
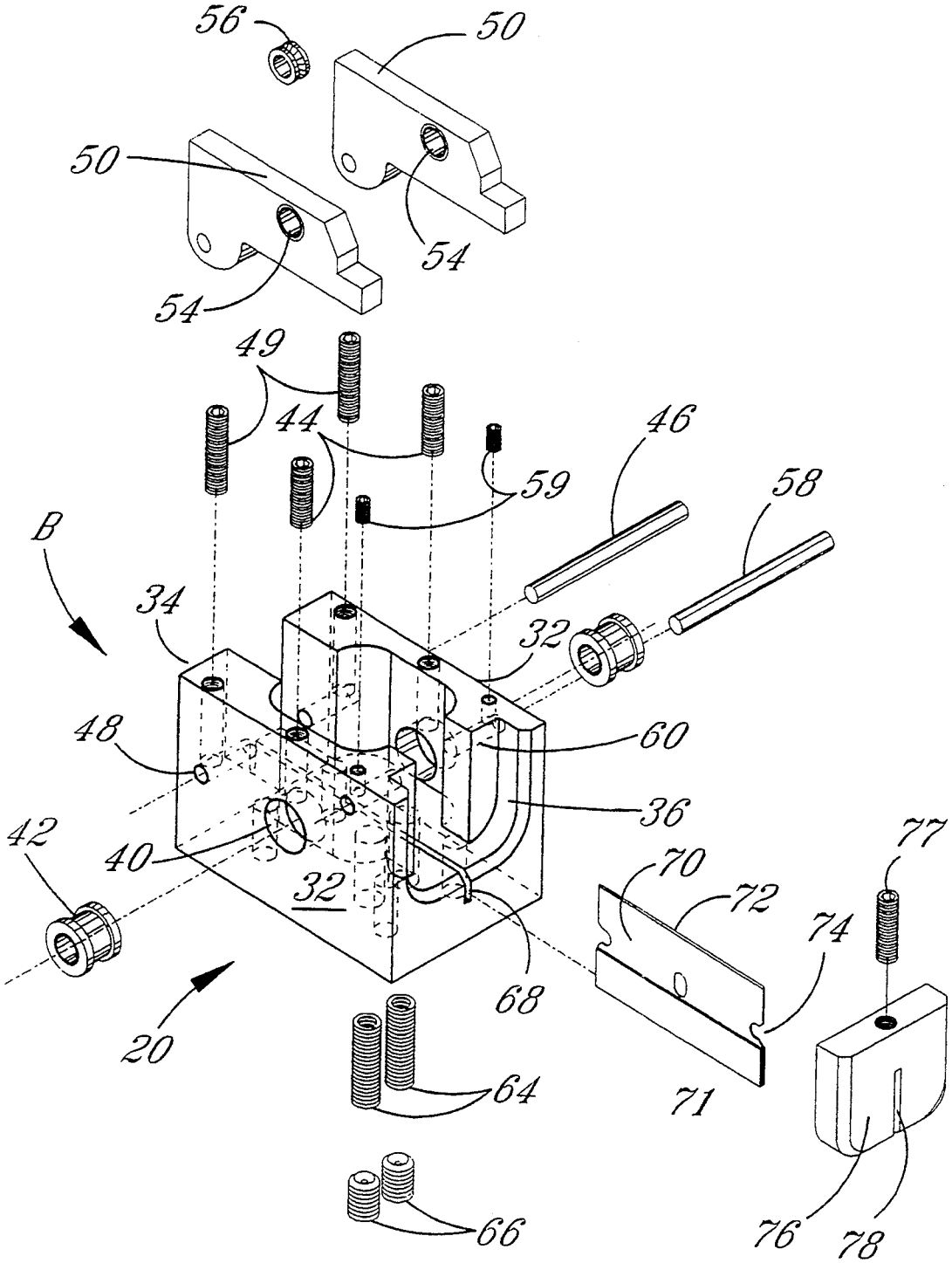
FIG. 2 is an exploded perspective view of the tension control device.

Referring now to FIGS. 1 and 2 where tension control device B is shown in detail. Housing 20 is substantially a hollow cube having front and rear walls 32, side wall 34, side opening 36 and bottom 38.

Apertures 40 are formed along a longitudinal axis in each of front and rear walls 32. A carbide bushing or eye 42 is fitted in each aperture 40 and locked in position with lock screw 44. Eyes 42 are adapted to guide weft thread through housing 20.

Axle 46 is mounted in aligned holes 48 drilled transversely through side wall 34. Set screws 49 lock axle 46 in position. Thread guide arms 50 are pivotally mounted at one end in spaced manner on axle 46 to extend from side 34 between front and rear walls 32 toward opening 34. The opposite upper ends of arms 50 are provided with a notch 52. Stop 58, which is mounted in apertures 60, formed in front and rear walls 32, is positioned to overlay notches 52 of arms 50. Stop 58 acts to limit the vertical movement of arms 50. Set screws 59 secure stop 58 in position.

Intermediate opposite ends of each of arms 50 there is formed an aperture 54 which may, if desired, be lined with a carbide bushing or eye 56. A pair of threaded bores 62 are formed in bottom 38 in position to under lie arms 50. Springs 64 are mounted in bores 62 with the upper end of each resting against the bottom surface of one of the arms 50. The resilient force of springs 64 against the underside of arms 50 is adjustable by moving set screws 66 in or out relative to floor 38 of housing 20.

Side opening 36 is filled with wedge 76 which is permanently secured therein by welding or other suitable means. With wedge 76 in place, housing 20 is substantially enclosed about all four sides.

A slot 69 is formed in the upper surface of bottom 38 to extend transversely of housing 20. Slot 68 is arranged to be between and parallel with arms 50. A vertical slit 78 is formed in wedge 76 and arranged to be aligned with slot 68. Slot 68 in combination with slit 78 are of sufficient size to receive cutting blade 70.

Cutting blade 70, which may be a commercial single edge razor blade, consists of cutting edge 72, base 71 and opposed side edge notches 74. Base 71 is adapted to slide along slot 68 as blade 70 is inserted through slit 78. With blade 70 positioned in housing 20, its forward end is secured against lateral and vertical movement by notch 74 engaging with axle 46. The trailing end of blade 70 is secured against lateral movement by set screw 77 which is secured in wedge 70 to engage with slit 78. Blade 70, at its trailing end, is secured against vertical movement by stop 58 which is positioned slightly above cutting edge 72.

In operation, housing 20 is fitted in shuttle A in position to receive thread 16 from bobbin 14 and to allow its passage to and through tensioning chamber 24 and eyelet 30.

Eyes 42 of front and rear walls 32 are arranged along a single longitudinal axis which is slightly below the vertical position of cutting edge 72 of blade 70.

Arms 50 are positioned on opposite sides of blade 70 with their upper surface substantially flush with the upper surface of walls 32 and with notch 52 resiliently urged in position against stop 58 by springs 64. Eyes 54 of arms 50 are arranged along a single longitudinal axis which is normally slightly above cutting edge 72 of blade 70. Eyes 42 and 54 are disposed along a single plane.

Thread 16 enters housing 20, passing through a first eye 42, then upward to pass through eyes 54 and over cutting edge 72. Thread 16 then moves downward to pass out of housing 20 through the second eye 42. During normal operation of shuttle A, this is the path traveled by thread 16 as it moves from bobbin 16 through housing 20 and out eye 30 to weave with the warp threads.

Upon excessive tension being applied against weft thread 16 at any point between bobbin 14 and the warp threads during its exit from shuttle A, the force of that tension will cause arms 50 to be pivoted downward toward the axis of eyes 42. This movement brings eyes 52 into the plane of cutting edge 72 which severs the weft yarn. Severing of weft yarn 16 removes the excess tension against the shuttle flight and allows it to continue along its normal path across the loom without causing a smash out.

Obviously many modifications are possible within the scope of the invention. For example, the material forming housing 20, eyes 42 and 56, arms 50 and blade 70 require only that they be sufficiently sturdy to withstand the shock and wear incurred during weaving. Also, the path of travel of the weft through housing 20 may be varied as desired, provided the device acts to severe the weft yarn upon the development of excessive tension therein.

While a preferred embodiment of the invention has been described using specific terms, such description is for illustrative purposes only, and it is to be understood that changes and variations may be made without departing from the spirit or scope of the following claims.

What is claimed is:

1. A weft thread tension control device for a wide loom shuttle comprising:

a housing having a pair of spaced, stationary eyes adapted to pass weft thread during its passage through said shuttle;

a cutting edge arranged intermediate said eyes and within said housing;

at least one vertically movable thread guide arranged intermediate said eyes and adjacent said cutting edge, a resilient member arranged to engage with said thread guide, said resilient member urging said thread guide into a normal position which maintains said weft thread away from said cutting edge during normal passage of said weft thread through said eyes of said housing; whereby, development of excessive tension in said weft thread during its passage through said thread tension control device forces, said thread guide to be moved from said normal position in which said weft thread is held away from said cutting edge into a position in which said weft thread engages with said cutting edge severing said weft thread.

2. The device according to claim 1 wherein said thread guide comprises an arm pivotally mounted within said housing and said resilient member comprises a spring resiliently urging said arm into said normal position.

3. The device according to claim 1 wherein said thread guide comprises a pair of arms pivotally mounted within said housing and adjacent said cutting edge, and said resilient member associated with each of said arms to independently urge each arm into said normal position.

4. The device according to claim 3 wherein said independent resilient members comprise a pair of springs; and, adjustable mounting members, said adjustable mounting members being arranged in said housing for adjustably mounting said springs within said housing.

5. The device of claim 3 wherein each of said arms includes an eye movable with said arm and through which said weft thread passes, said movable eyes of said arms being arranged along a common plane.

6. The device of claim 5 wherein said stationary eyes of said housing and said movable eyes of said arms are arranged along a common plane.

7. The device of claim 1 wherein a carbide bushing lines said eyes.

8. The device of claim 1 wherein said cutting edge is formed on a cutting blade, said cutting blade being removably mounted within said housing.

9. A weft thread tension control device for use in a shuttle:

said shuttle comprising a bobbin compartment which supports a weft thread carrying bobbin, an excessive weft thread tension control device, a weft thread tensioning apparatus and a shuttle eye, said weft thread passing from said bobbin through said excessive tension control device, said tensioning apparatus and said shuttle eye as it passes from said bobbin compartment and through said shuttle;

said excessive tension control device comprises a housing mounted within said bobbin compartment between said bobbin and said tensioning apparatus, said housing comprising a plurality of stationary thread guide eyes, at least one movable thread guide eye and a stationary cutting edge;

said stationary thread guide eyes being arranged within said housing to normally lie along a single plane parallel with the longitudinal axis of said bobbin and below said cutting edge;

said movable thread guide eye being arranged to be normally positioned spaced from said longitudinal axis of said bobbin and above said cutting edge; whereby said weft thread is guided past said cutting edge with said movable guide eye in said spaced position during withdrawal of said weft thread through said shuttle under normal tension and upon development of excessive tension in said weft thread during its passage through said shuttle, said movable guide eye is drawn toward said longitudinal axis bringing said weft thread into engagement with said cutting edge, severing said thread.

* * * * *